US008818227B2

(12) United States Patent
Suzumi

(10) Patent No.: US 8,818,227 B2
(45) Date of Patent: Aug. 26, 2014

(54) IMAGE FORMING APPARATUS FOR SHIFTING TO A POWER SAVING MODE AFTER A LAPSE OF A PREDETERMINED TIME

(75) Inventor: Masahiko Suzumi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 13/302,401

(22) Filed: Nov. 22, 2011

(65) Prior Publication Data

US 2012/0141155 A1 Jun. 7, 2012

(30) Foreign Application Priority Data

Dec. 2, 2010 (JP) ..... 2010-269736

(51) Int. Cl.
*G03G 15/20* (2006.01)

(52) U.S. Cl.
USPC ..... 399/70

(58) Field of Classification Search
USPC ..... 399/70, 69, 320, 68, 67, 324; 219/216
See application file for complete search history.

(56) References Cited

U.S. PATENT DOCUMENTS

| | | | | | |
|---|---|---|---|---|---|
| 5,745,247 | A * | 4/1998 | Yasui et al. | ..... | 358/296 |
| 5,832,340 | A * | 11/1998 | Kosagi et al. | ..... | 399/88 |
| 5,899,599 | A * | 5/1999 | Kato | ..... | 399/69 |
| 2004/0131375 | A1 * | 7/2004 | Lee | ..... | 399/69 |
| 2009/0252520 | A1 * | 10/2009 | Segawa | ..... | 399/69 |

FOREIGN PATENT DOCUMENTS

| | | | | | |
|---|---|---|---|---|---|
| JP | 8-069205 | A | | 3/1996 | |
| JP | H11-352825 | A | | 12/1999 | |
| JP | 2002-169407 | A | | 6/2002 | |
| JP | 2002-244502 | A | | 8/2002 | |
| JP | 2003-098899 | A | | 4/2003 | |
| JP | 2003098899 | A | * | 4/2003 | ..... G03G 15/20 |
| JP | 2011-123235 | A | | 6/2011 | |

* cited by examiner

*Primary Examiner* — Billy Lactaoen
(74) *Attorney, Agent, or Firm* — Canon USA, Inc. IP Division

(57) ABSTRACT

A fixing rotational body is rotated immediately before shifting from a standby mode to a power saving mode in which not only power supply to a heater and the rotation of the fixing rotational body are stopped but also a timer is stopped so that the reliability of the thermistor detection temperature when returning from the power saving mode is improved, and fixing defect is prevented while power consumption in the power saving mode is reduced.

10 Claims, 11 Drawing Sheets

IMAGE FORMING APPARATUS FOR SHIFTING TO A POWER SAVING MODE AFTER A LAPSE OF A PREDETERMINED TIME

BACKGROUND OF THE INVENTION

1. Field of the Invention

The present invention relates to image forming apparatuses, and more particularly, to an image forming apparatus that shifts to a power saving mode after a lapse of a predetermined time from the end of printing.

2. Description of the Related Art

Many conventional electrophotographic copiers and printers adopt a heating roller fixing device of a contact heating type with high efficiency and safety or a film heating system as a heat fixing portion.

The heating roller fixing portion of the heating roller fixing system is mainly composed of a heating roller (fixing roller) serving as a heating rotational body and an elastic roller serving as a heating rotational body that is in pressure contact therewith. The roller pair is rotated so that a recording material (recording sheet, electrostatic recording sheet, electrofax sheet, print sheet, etc.) serving as a workpiece on which an unfixed image (hereinafter, referred to as a toner image) is formed and born is introduced into a fixing nip portion that is a pressure contact nip portion between the roller pair and is conveyed through the fixing nip portion, and thus, the toner image is fixed as a permanent image on the surface of the recording material with heat from the heating roller and the pressure of the fixing nip portion.

The heat fixing portion of the film heating system is a device in which a heat resistive film (fixing film), which is a heating rotational body, is slidingly conveyed while it is brought into contact with a fixed heater, such as a ceramic heater, using a pressing rotational body (elastic pressure roller), and a recording material bearing a toner image is introduced into a fixing nip portion, which is a contact pressure nip portion formed between the heater and the pressing rotational body, with the film interposed therebetween, and is conveyed together with the film to thereby fix the toner image on the recording material as a permanent image with heat applied from the heater via the film and the pressure of the fixing nip portion.

These heat fixing portions perform heating fixation in such a manner that a temperature detection device, such as a thermistor, is disposed at the heating roller or the ceramic heater, serving as a heating member, to control the fixing temperature to a desired degree. In this case, if it is controlled to a constant fixing temperature, the amount of heat applied to the sheet changes depending on the degree of warming of heat fixing portion, in particular, the pressure roller, which sometimes cause fixing defect or hot offset. Therefore, various methods for controlling the fixing temperature depending on the degree of warming of the heat fixing portion have been proposed.

For example, Japanese Patent Laid-Open No. 2002-169407 discloses a method of measuring a print stop time and setting a fixing temperature from the measurement, and Japanese Patent Laid-Open No. 08-69205 discloses a method for setting an optimum fixing temperature from a printing time and number-of-prints information.

Power saving of the apparatus has recently been required, and in particular, reduction of power consumption during standby has been required. Therefore, a power saving mode (hereinafter referred to as a sleep mode) is widely adopted in which power consumption is reduced by, for example, a method of shutting off power supply of part of the electric circuit of the apparatus during standby.

However, the sleep mode also reduces power supply to a CPU or the like that controls the apparatus, which makes it impossible to monitor the temperature of the heat fixing portion and perform timer measurement and calculating operation of a number-of-prints counter or the like, etc. during the sleep mode. Thus, there is no information indicating the temperature changes of the heat fixing portion and the degree of warming of the heat fixing portion, such as the stop time and the number of prints; therefore, a fixing temperature for a print job after returning from the sleep mode is determined only from the detection temperature, at the start of printing, of a temperature detection device disposed at the heating member. This precludes appropriate fixing temperature control based on the degree of warming of the heat fixing portion, thus posing the situation of insufficient heat supply to sheets to cause fixing defect or the situation of excessive heat supply to cause hot offset.

Thus, there is also a method in which a temperature detection device, such as a thermistor, is disposed on the surface of the pressure roller, and the fixing temperature is determined depending on the degree of warming of the pressure roller. However, an additional temperature detection device and a detection circuit may be needed for temperature detection, thus increasing the cost.

Furthermore, increasing power supply to the CPU to allow temperature monitoring and the calculating operation of the number-of-prints counter etc. for controlling the fixing temperature makes it impossible to reduce the power consumption during standby, which makes it impossible to respond to the request for power consumption.

SUMMARY OF THE INVENTION

The present invention provides an apparatus comprising a forming portion that forms an image on a recording material; a fixing portion including a heating member and a pressing member that forms a fixing nip portion with the heating member, the heat fixing portion fixing the image formed on the recording material by heating; and a timer; wherein after printing is finished, the apparatus shifts to a standby mode in which power supply to the heating member, and rotations of the heating member and the pressing member stop, and in which the timer is activated, and when a power-saving-mode shift time is reached in the standby mode, the apparatus shifts to a power saving mode in which the timer stops, and wherein the heating member and the pressing member rotate immediately before shifting to the power saving mode.

The present invention further provides an apparatus comprising a forming portion that forms an image on a recording material, a fixing portion including a heating member, a pressing member that forms a fixing nip portion with the heating member, the fixing portion fixing the image formed on the recording material by heating, and a temperature detection device that detects temperature of the heating member; and a timer; wherein after printing is finished, the apparatus shifts to a standby mode in which power supply to the heating member and rotations of the heating member and the pressing member stop, and in which the timer is activated, and when a power-saving-mode shift time is reached in the standby mode, the apparatus shifts to a power saving mode in which the timer stops, and wherein when a print job is input in the power saving mode, the heating member and the pressing member rotate before the temperature detection device detects the temperature.

Further features of the present invention will become apparent from the following description of exemplary embodiments with reference to the attached drawings.

DESCRIPTION OF THE EMBODIMENTS

First Embodiment

Figure 1:
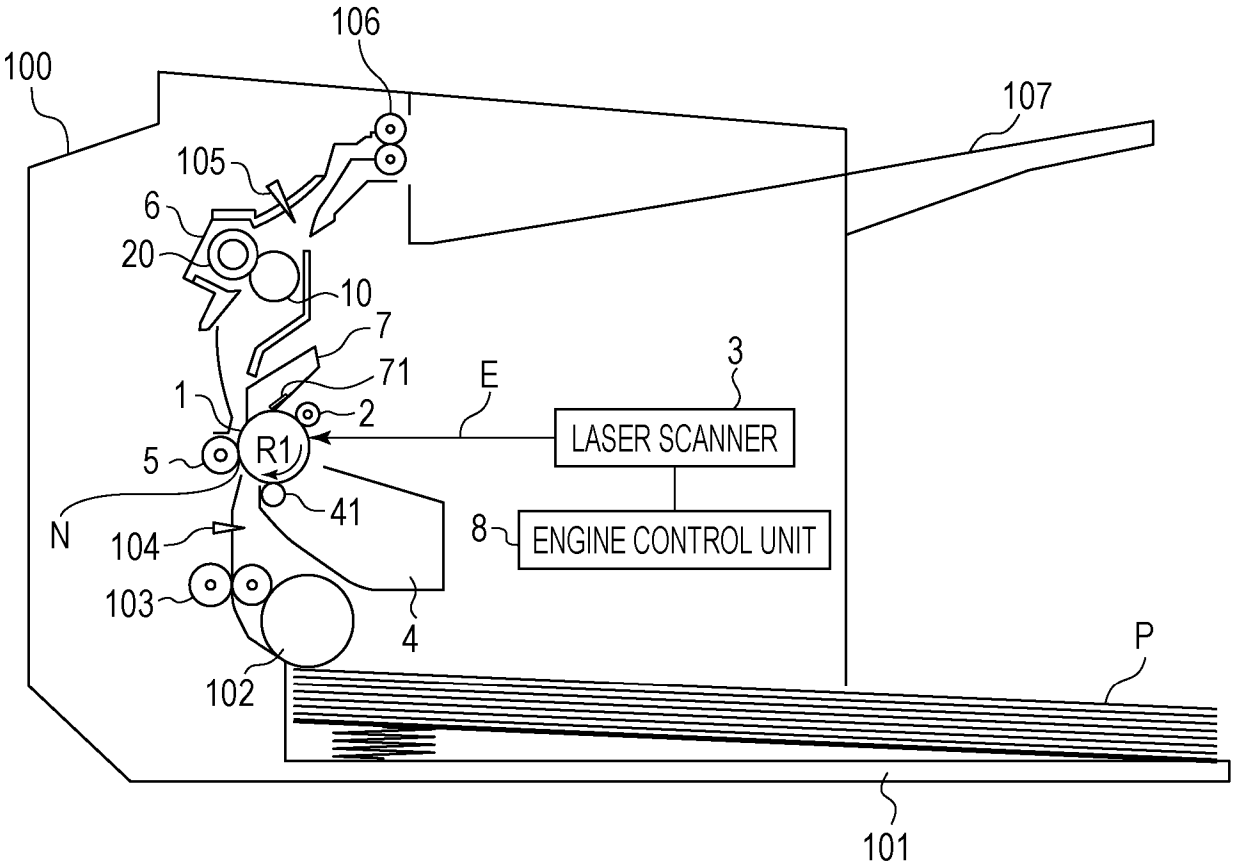
FIG. 1 is a diagram (sectional view) illustrating an image forming apparatus according to an embodiment of the present invention.

An embodiment of the present invention will be described hereinbelow. FIG. 1 illustrates an image forming apparatus according to an embodiment of the present invention. FIG. 1 is a longitudinal sectional view illustrating, in outline, the configuration of a laser printer as an example of the image forming apparatus according to an embodiment of the present invention.

The image forming apparatus shown in FIG. 1 is equipped with an electrophotographic photosensitive member (hereinafter referred to as a photosensitive drum) 1. The photosensitive drum 1 is rotationally driven in the direction of arrow R1 at a predetermined process speed (peripheral speed) by a driving unit (not shown). The surface of the photosensitive drum 1 is uniformly charged to predetermined polarity and potential by a charging roller 2. After charging, an electrostatic image is formed on the photosensitive drum 1 by irradiation of a laser beam E from a laser scanner 3. The laser scanner 3 performs scanning exposure that is ON/OFF controlled in accordance with image information to remove electric charge at an exposed portion, thereby forming an electrostatic image on the surface of the photosensitive drum 1. This electrostatic image is developed by a developing unit 4 into a visual image. The electrostatic image is developed using a toner supplied from a developing roller 41.

The toner image on the photosensitive drum 1 is transferred onto the surface of a recording material P. The recording material P accommodated in a paper feed tray 101 is fed one by one by a paper feed roller 102 and is supplied to a transfer nip portion N between the photosensitive drum 1 and a transfer roller 5 via a conveying roller 103 and so on. At that time, the leading end of the recording material P is sensed by a top sensor 104, at which the timing when the leading end of the recording material P reaches the transfer nip portion N is determined from the position of the top sensor 104, the position of the transfer nip portion N, and the conveyance speed of the recording material P. The toner image on the photosensitive drum 1 is transferred onto the recording material P conveyed as described above by applying a transfer bias to the transfer roller 5. This is the image forming portion that forms an image on a recording material.

The recording material P onto which the toner image is transferred is conveyed to a heat fixing portion 6, where it is subjected to a fixing process. Thereafter, the recording material P is ejected onto a paper output tray 107 formed on the upper surface of an image forming device 100 by an eject roller 106, during which a paper output sensor 105 detects the timing at which the leading end and the trailing end of the recording material P pass to monitor whether a jam or the like has occurred. On the other hand, toner remaining on the surface of the photosensitive drum 1 after the toner image is transferred is removed by a cleaning blade 71 of a cleaning portion 7. By repeating the above operation, images can be continuously formed. The image forming apparatus of this embodiment is an apparatus example with a 600 dpi, 26 sheets/min. (LTR longitudinal feed, processing speed: about 150 mm/sec.), and a lifetime of 50,000 sheets.

The image forming apparatus of this embodiment has a sleep mode (power saving mode) in which power supply to electric circuits of an engine control unit 8 and so on is reduced to reduce power consumption during waiting for a print job, and if printing is not performed for a predetermined time (which can be set in minutes to any time up to 5 minutes), which is a sleep-mode shift time (power-saving-mode shift time), after printing is finished, the image forming apparatus automatically shifts to the sleep mode.

Heat Fixing Portion

Figure 2:
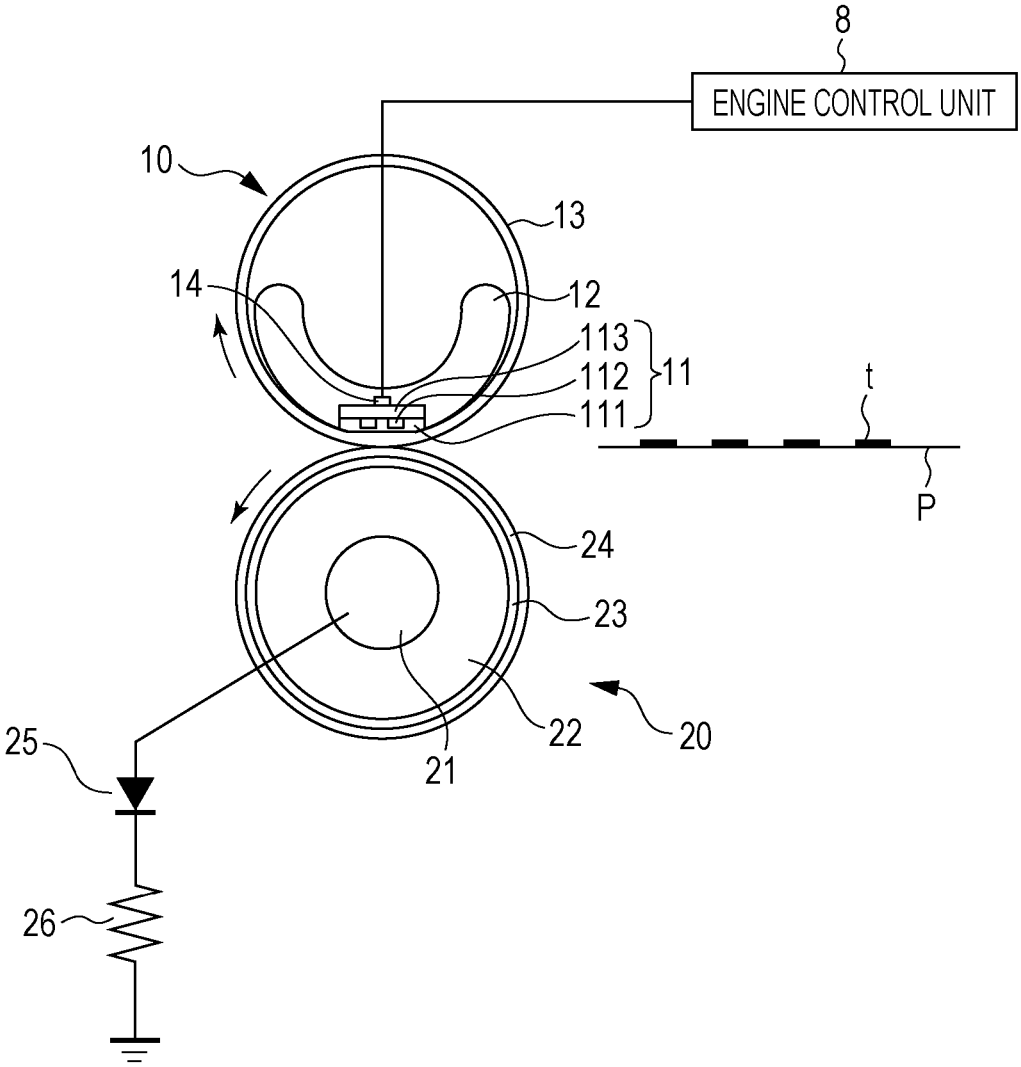
FIG. 2 is a diagram (sectional view) illustrating the configuration of a heat fixing portion.

FIG. 2 illustrates the configuration of the heat fixing portion 6. In FIG. 2, a heating member 10 includes a fixing film (endless belt) 13 and a heater 11. The fixing film 13 is a composite-layer film having a low heat capacity and formed by coating or tube-covering the surface of a thin metal element tube made of stainless (SUS) or the like or a heat-resistive plastic film made of polyimide, PEEK, or the like with a release layer, such as PFA, PTFE, and FEP. The heater 11 is a ceramic heater in contact with the inner surface of the fixing film 13, in which a conductive heat generation resistive layer 112 made of silver palladium or the like is formed on an alumina or aluminum nitride substrate 111, and the heat-generation resistive layer 112 is covered with a glass layer 113. The surface of the heater 11 opposite the sliding surface of the fixing film 13 is in contact with a thermistor 14 serving as a temperature detection device. During a fixing process, the engine control unit 8 controls power to be supplied to the heating member 10 (heater 11 in this embodiment) so that the detection temperature of the thermistor 14 maintains a fixing temperature (target control temperature).

A holder 12 is made of a heat resistive plastic and holds the heater 11. The fixing film 13 rotates around the heater 11 and the holder 12 in the direction of the arrow by receiving a force from a pressing member (pressure roller) 20. The pressure roller 20 forms a fixing nip portion, together with the heating member 10, for thermally fixing a toner image t formed on the recording material P to the recording material P. The pressure roller 20 has, on a core metal 21, an elastic layer (rubber layer) 22, an adhesive layer 23, and a fluoroethylene plastic release layer 24. The pressure roller 20 is driven by a motor (not shown).

Since the heat fixing portion 6 of this embodiment uses the fixing film 13, the fixing nip portion for thermally fixing the toner image t formed on the recording material P to the recording material P is constituted by the heater 11 and the pressure roller 20, with the fixing film 13 interposed therebetween. A diode 25 and a resistor 26 are provided to prevent the toner from offset.

Temperature Control of Heat Fixing Portion

Figure 3:
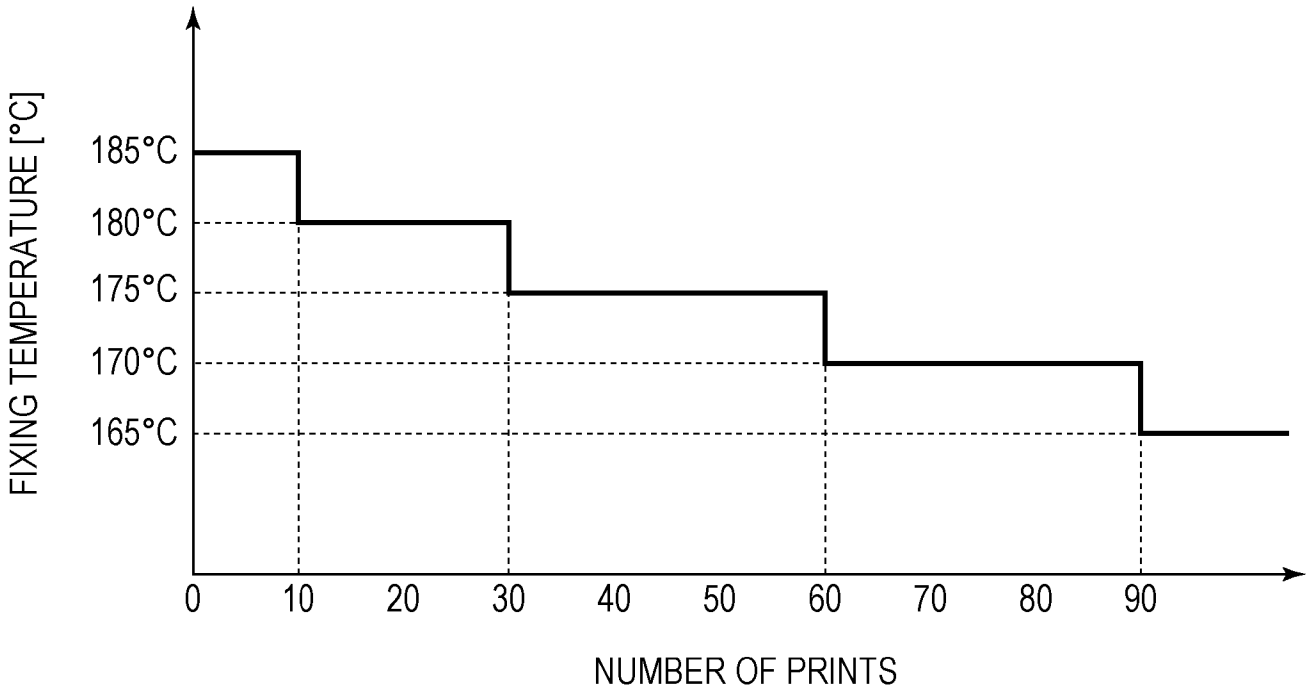
FIG. 3 is a diagram showing changes in fixing temperature (target control temperature) setting for continuous printing.

Next, temperature control of the heat fixing portion of this embodiment will be described. As described in Background of the Invention, preventing fixing defect and hot offset in the heat fixing portion 6 requires appropriately setting the fixing temperature depending on the degree of warming of the pressure roller 20. To that end, as shown in FIG. 3, this embodiment is configured, in continuous printing from a state in which the heat fixing portion 6 is cool (at room temperature), to perform control such that the fixing temperature is decreased in accordance with the number of prints, in other words, as the pressure roller 20 is warmed (for example, a fixing temperature (target control temperature) set when the number of prints is 1 is 185° C., and a fixing temperature set when the number of prints is 40 is 175° C.). This allows the heat to be applied to the paper to be substantially the same irrespective of the degree of warming of the pressure roller 20, thereby preventing occurrence of fixing defect and hot offset.

Also for intermittent printing (a printing period and a period during which the rotations of the fixing film 13 and the pressure roller 20 and the driving of the heater 11 stop are repeated in a short cycle), a fixing temperature for a new job is changed depending on the number of prints of an immediately preceding job and the intermittent time (job waiting time). Specifically, the number of prints counted in the immediately preceding job is decreased with time while no printing is performed (until a new job occurs), and a fixing temperature set for the first sheet of the new job is set to a temperature corresponding to the number of prints at the point where the new job has occurred.

With the configuration of this embodiment, the fixing temperature is set depending on the degree of warming of the heat fixing portion 6 by decreasing the number of prints by one per (360/Cn) second while no printing is performed, where Cn is a number-of-prints count value at the end of printing. The reason why the time during which the count value Cn is decreased differs depending on the count value Cn is that the decreasing speed of the pressure roller temperature differs depending on the time elapsed.

EXPERIMENTAL EXAMPLES

Next, specific experimental examples will be described. As described above, the image forming apparatus of this embodiment performs a number-of-prints calculating process while waiting for a print job (in a standby mode) after the end of a print job to set an appropriate fixing temperature depending on the degree of warming of the pressure roller 20. However, if no new job occurs within a set sleep-mode shift time (any time in minutes up to 5 minutes) after printing is finished, the apparatus shifts to the sleep mode, in which power supply to the engine control unit 8 is inhibited. This makes it impossible to measure a printing intermission period with a timer, thus making the number-of-prints calculating process impossible. Accordingly, the number-of-prints count value used for setting the fixing temperature becomes unavailable.

Figure 4:
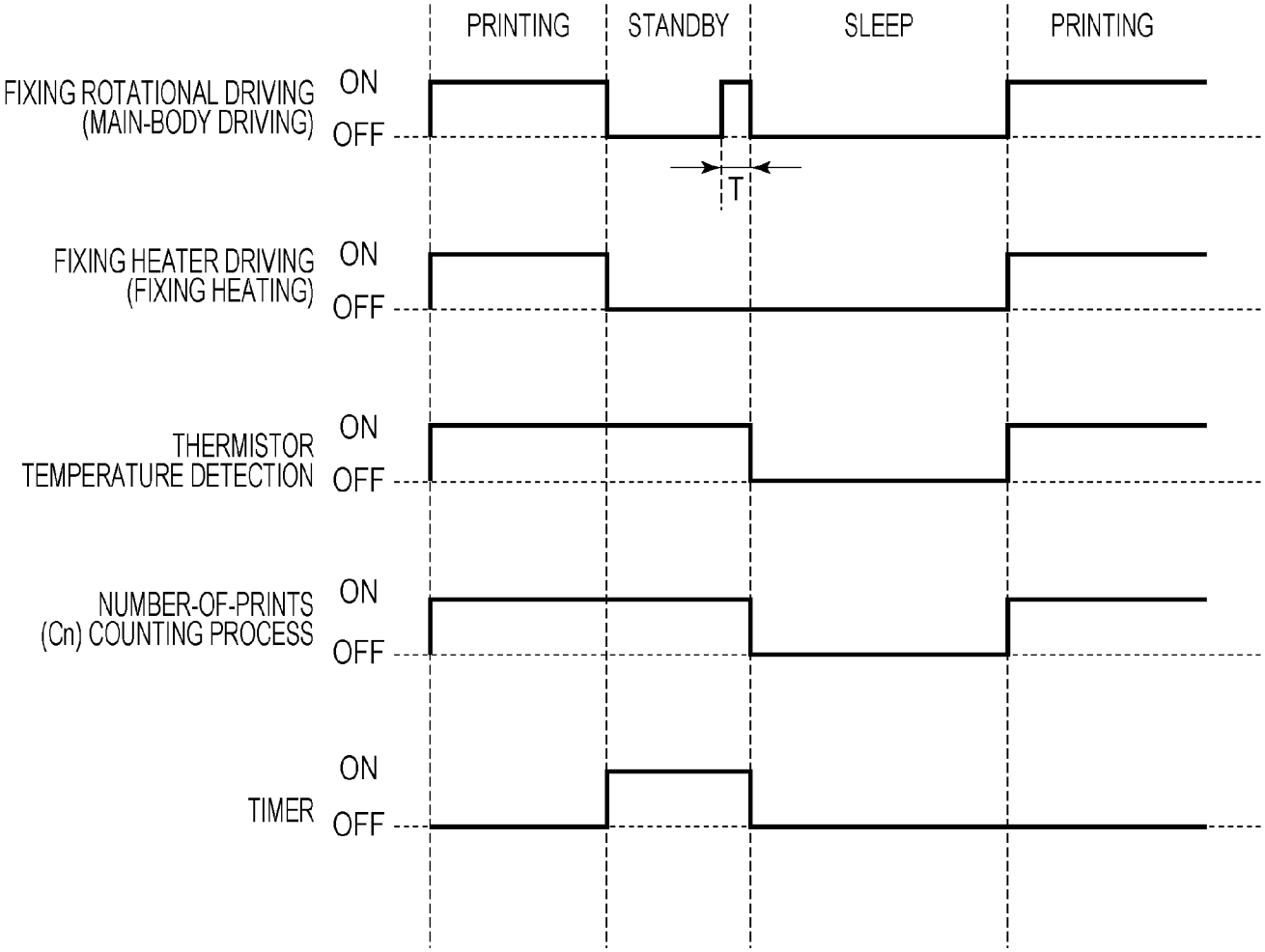
FIG. 4 is a time chart showing the operation state of the heat fixing portion.

FIG. 4 shows a time chart showing the operation state of the heat fixing portion 6. As shown in FIG. 4, after printing is finished, the image forming apparatus shifts to a standby mode in which the input of a print signal (print job) is waited for. During the period of the standby mode, although rotational driving and heater driving are stopped, the heater temperature can be detected by the thermistor 14, and the number-of-prints counter and the timer are also in operation. In other words, after printing is finished, the image forming apparatus shifts to the standby mode in which power supply to the heating member 10 and the rotations of the heating member 10 and the pressing member 20 are stopped, and in which the timer operates. When the time passes in the standby mode without no print signal is input, and a sleep-mode shift time is reached, the image forming apparatus shifts to a sleep mode (power saving mode). In the sleep mode, because temperature detection of the thermistor 14 cannot be performed, and the timer is also stopped, as shown in FIG. 4, the number-of-prints counting process is also disabled. In other words, when the power-saving-mode shift time is reached in the standby mode, the image forming apparatus shifts to the power saving mode in which the timer stops. Accordingly, if a new print job occurs after shifting to the sleep mode, only the detection temperature of the thermistor 14 at the point where the new print job has occurred (that is, the degree of warming of the heat fixing portion 6 estimated from the detection temperature of the thermistor 14) is available for setting a fixing temperature. However, it is difficult to determine the degree of warming of the heat fixing portion 6 only from the detection temperature of the thermistor 14, which makes it difficult to set an appropriate fixing temperature. The reason will be described using FIG. 5.

Figure 5:
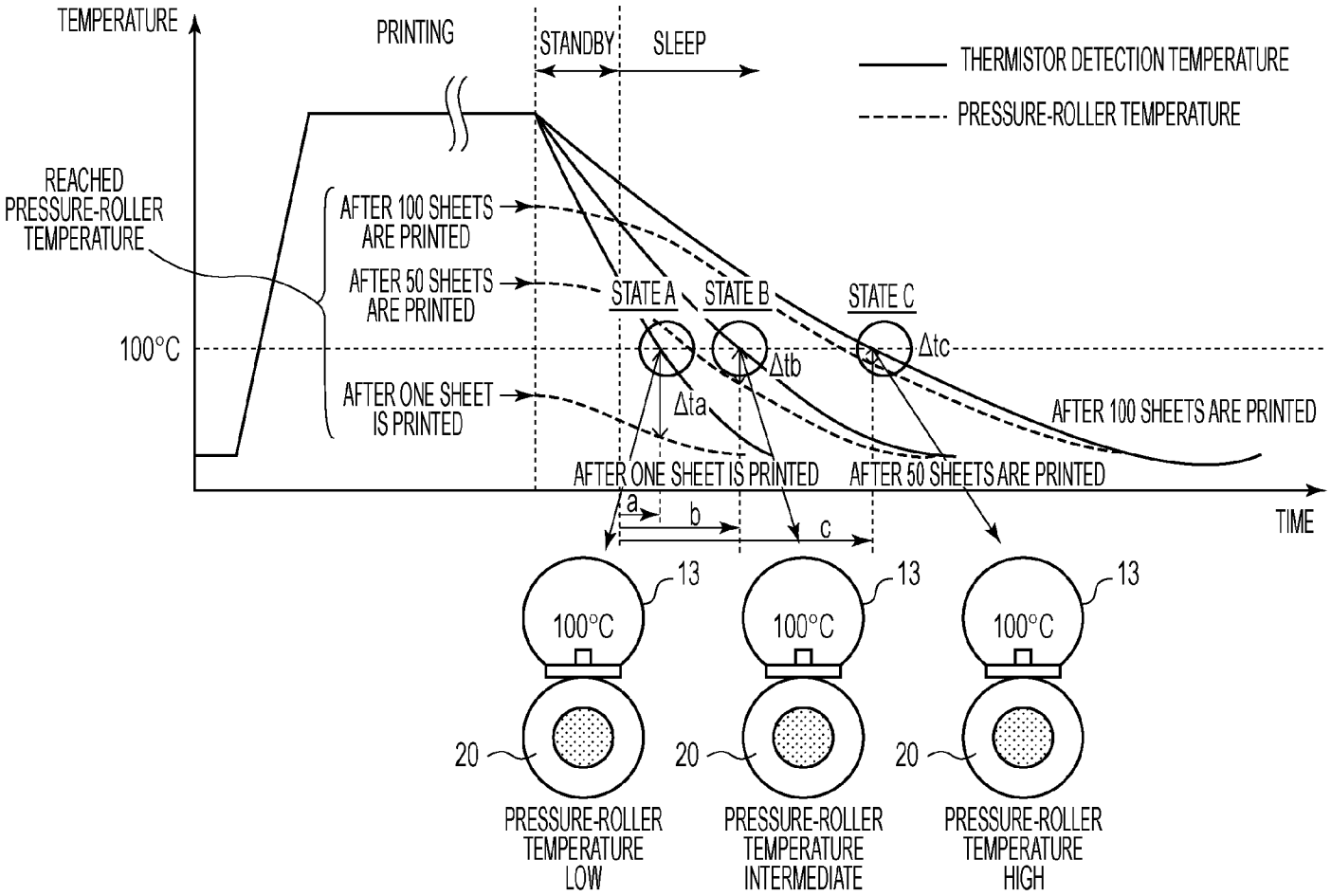
FIG. 5 is a diagram illustrating the difference between the detection temperature of a thermistor and the degree of warming of a pressure roller after shifting to a sleep mode.

FIG. 5 is a diagram illustrating changes in the detection temperature of the thermistor 14 and the surface temperature of the pressure roller 20 (the surface temperature of a portion other than the fixing nip portion) in the case where one sheet is printed, 50 sheets are printed, and 100 sheets are printed, respectively, from a state in which the heat fixing portion 6 is cool. State A in FIG. 5 is a state after one sheet is printed, in which case the vicinity of the heating member 10 is warmed, but the pressure roller 20 is not quite warmed. Therefore, after printing is finished, at the point where the thermistor detection temperature (heater temperature) is decreased to 100° C., the difference Δta between the detection temperature of the thermistor 14 and the temperature of the pressure roller 20 is large. This is because the temperature that the pressure roller 20 has reached during printing is relatively low, and the pressure roller 20 is in a state in which only the vicinity of the surface layer is warmed, and thus, the cooling speed of the surface of the pressure roller 20 other than the fixing nip portion after printing is finished and the rotation is stopped is high.

State B is a state after 50 sheets are printed. In this case, the pressure roller 20 is warmed to some extent due to the heat fixing process, but the difference Δtb between the detection temperature of thermistor 14 and the temperature of the pressure roller 20 is relatively low at the point where the thermistor detection temperature has decreased to 100° C. This is because the temperature that the pressure roller 20 has reached during printing is relatively high, so that the vicinity of the center of the pressure roller 20 is warmed, and the cooling speed of the surface of the pressure roller 20 other than the fixing nip portion is relatively low.

State C is a state after 100 sheets are printed. In this case, because the heating member 10 and the pressure roller 20 are sufficiently warmed due to the heat fixing process, the difference Δtc between the detection temperature of the thermistor 14 and the temperature of the pressure roller 20 is extremely small at the point where the thermistor detection temperature is decreased to 100° C. This is because the temperature that the pressure roller 20 has reached during printing is so high that the core metal 21 at the center of the pressure roller 20 is warmed, and the cooling speed of the surface of the pressure roller 20 other than the fixing nip portion is low.

As in these three states, the temperatures of the pressure roller 20 at the point where the detection temperature of the thermistor 14 has reached 100° C. are not always the same. Accordingly, an appropriate fixing temperature for the first sheet of a new job cannot be set only on the basis of the detection temperature information of the thermistor 14 at the point where the image forming apparatus has returned from the sleep mode (the point where a new print job has occurred) because it cannot be determined which of state A, state B, and state C in FIG. 5 the image forming apparatus is in. Thus, it is difficult to set an appropriate fixing temperature only from the detection temperature of the thermistor 14. Accordingly, it is difficult to set an appropriate fixing temperature in the case where a print job is generated after shifting to the sleep mode (particularly immediately after shifting to the sleep mode in which the timer stops, and thus, the number-of-prints counting process cannot be performed.

As described above, since there are two cases, that is, the where the difference between a change in thermistor detection temperature (heater temperature) and a change in the pressure roller temperature after printing is finished is large (state A in FIG. 5 A) and the case where the difference is small (state C in FIG. 5), the true temperature state of the pressure roller 20 cannot be determined only from the detection temperature information of the thermistor 14.

Thus, in this embodiment, the heat fixing portion 6 (specifically, the pressure roller 20 and the fixing film 13 following the pressure roller 20) is rotated immediately before shifting to the sleep mode (time T in FIG. 4). By rotating the heat fixing portion 6, the portions of the heating member 10 and the pressure roller 20 other than the fixing nip portion in the rotation stop state come into contact with each other, and thus, ununiformity of the temperature of the heat fixing portion 6 is resolved. Accordingly by rotating the heat fixing portion 6 before shifting to the sleep mode, the true degree of warming of the heat fixing portion 6 (particularly, the real degree of warming of the pressing member 20) can be determined by the thermistor 14, which allows appropriate temperature control. It is also possible to rotate the heat fixing portion 6 and thereafter detect the temperature with the thermistor 14 not before shifting to the sleep mode but when returning from the sleep mode to start printing. However, rotating the heat fixing portion 6 when returning from the sleep mode poses the situation that first printout time (FPOT) is delayed, and thus, the rotation can be performed before shifting to the sleep mode.

Figure 6:
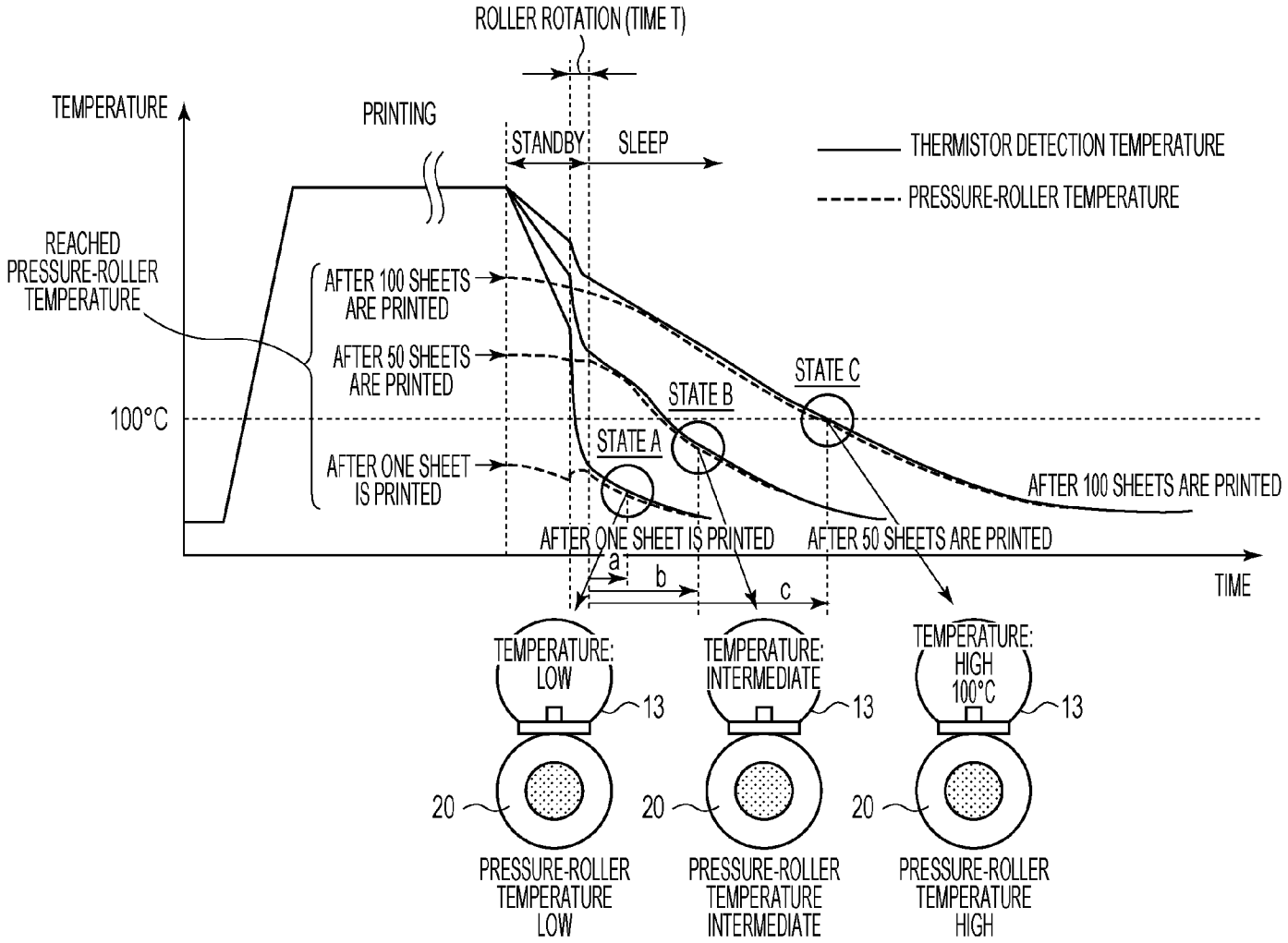
FIG. 6 is a diagram illustrating the difference between the detection temperature of the thermistor and the degree of warming of the pressure roller when the rotating operation is performed immediately before shifting to the sleep mode.

Table 1 shows the detection temperatures of the thermistor 14 of this embodiment at the same point as that where the detection temperature has reached 100° C. in the states A to C shown in FIG. 5, respectively, (state A: after a seconds from shifting to the sleep mode, state B: after b seconds, state C: after c seconds). The heat fixing portion 6 is rotated immediately before shifting to the sleep mode in states A, B, and C, respectively (for time T in FIG. 4). Differences in the detection temperature of the thermistor 14 are examined, with the time T varied to 3 seconds, 5 seconds, and 8 seconds. The rotating time T of 0 second is of a case where this embodiment is not performed (that is, the rotation immediately before shifting to the sleep mode is not performed). FIG. 6 illustrates temperature changes when this embodiment (rotation immediately before shifting to the sleep mode) is executed.

TABLE 1

Changes in Thermistor Detection Temperature with Rotation of Heat Fixing Portion

| Fixing Portion Rotation Time T | State A (After a seconds) | State B (After b seconds) | State C (After c seconds) |
|---|---|---|---|
| 0 second | 100° C. | 100° C. | 100° C. |
| 3 seconds | 70° C. | 84° C. | 98° C. |
| 5 seconds | 50° C. | 81° C. | 96° C. |
| 8 seconds | 49° C. | 79° C. | 95° C. |

As in state C shown in Table 1 and FIG. 6, in a state in which the entire heat fixing portion 6 is warmed, in particular, the pressure roller 20 is sufficiently warmed, the whole is uniformly warm, and thus the detection temperature of the thermistor 14 hardly changes even if the heat fixing portion 6 is rotated. In contrast, in the case where, as in state A and state B, the pressure roller 20 is not sufficiently warmed, and thus, there is a difference in temperature between the heating member 10 and the pressure roller 20, heat transfers from the heating member 10 to the pressure roller 20 due to the rotation of the heat fixing portion 6 to uniformize the temperature of the heat fixing portion, and thus, the detection temperature of the thermistor 14 in the vicinity of the heating member 10 decreases. Furthermore, the detection temperature of the thermistor 14 becomes unchanged at around 5 seconds of rotation of the heat fixing portion 6, thus uniformizing the temperature of the heat fixing portion 6. Although Table 1 shows only the results for states A to C, the temperatures can be uniformized at different number of prints and stop times by rotating the heat fixing portion 6 for 5 seconds.

In this way, by executing the rotation immediately before shifting to the sleep mode or before returning from the sleep mode and detecting the temperature with the thermistor 14, the detection temperature of the thermistor 14 indicates a value close to the true degree of warming of the heat fixing portion (in particular, the pressure roller 20). Thus, even if the number-of-prints (Cn) counting process is not performed, an appropriate fixing temperature can be set only by detecting the temperature with the thermistor 14 at the start of printing. Table 2 shows fixing temperatures to be set depending on the detection temperature of the thermistor 14.

TABLE 2

Relationship between Thermistor Detection Temperature and Optimum Fixing Temperature

| Thermistor Detection Temperature | Optimum Fixing Temperature |
|---|---|
| Lower than 50° C. | 185° C. |
| 50° C. or higher and lower than 75° C. | 180° C. |
| 75° C. or higher and lower than 100° C. | 175° C. |
| 100° C. or higher and lower than 125° C. | 170° C. |
| 125° C. or higher | 165° C. |

Figure 7:
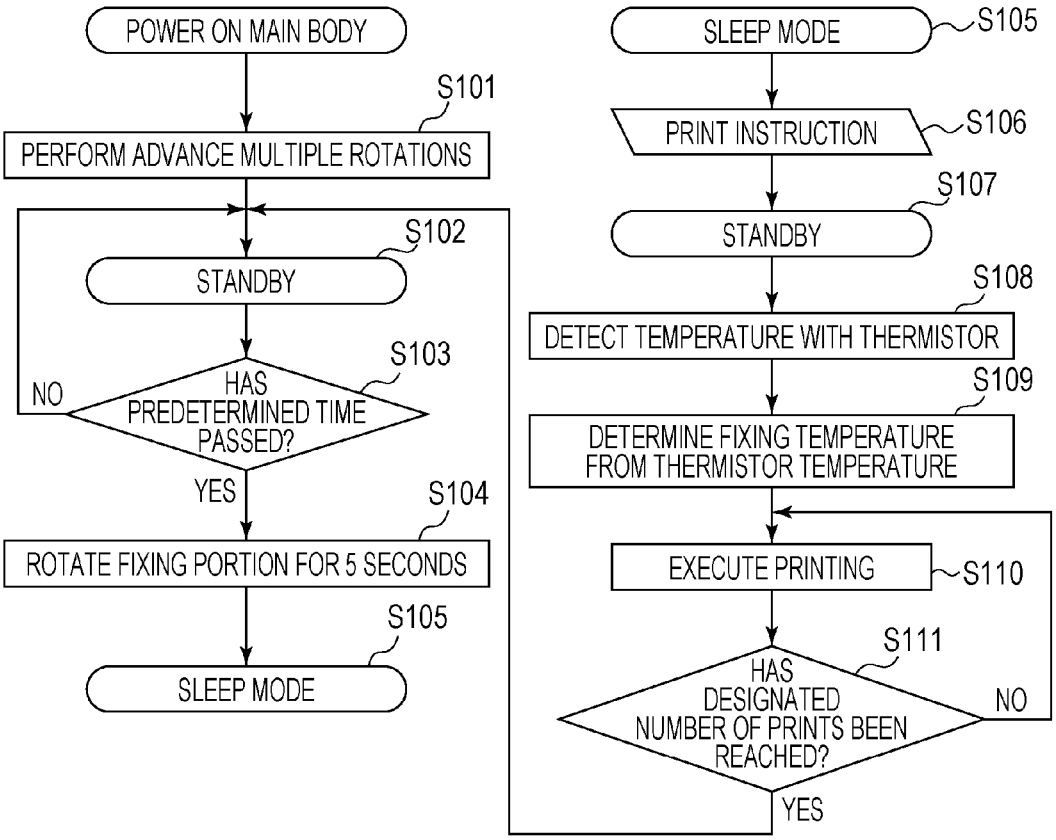
FIG. 7 is a flowchart showing a method for setting the fixing temperature of the first embodiment.

Next, the details of the fixing temperature control of this embodiment will be described using a flowchart in FIG. 7. First, the main body is turned on, and then advance multiple rotation is performed to make preparation for image formation (step S101), and then the apparatus goes into a standby state (ready state) in which printing is possible (step S102). Thereafter, it is determined whether a predetermined time has passed (step S103), where if it is determined that the predetermined time has not passed, the standby state is maintained, and at the point where the predetermined time has passed, the heat fixing portion 6 is rotated for 5 seconds (step S104), and the apparatus shifts to a sleep mode (step S105).

Next, the details of control for performing printing from the sleep mode will be described. On reception of a print instruction in the sleep mode (step S106), power supply to the electric circuit is resumed, and the apparatus shifts to the standby state (step S107). Next, the temperature of the heat fixing portion 6 is detected by the thermistor 14 (step S108), and a fixing temperature is set in accordance with the detected temperature information of the thermistor 14. Thereafter, a designated number of sheets are printed at the set fixing temperature (steps S110 and 111), and the apparatus shifts to the standby state (step S102). Thereafter, if no print job occurs within the predetermined time, the heat fixing portion 6 is rotated for 5 seconds (step S104), and the apparatus shifts to the sleep mode (step S105).

Figure 8:
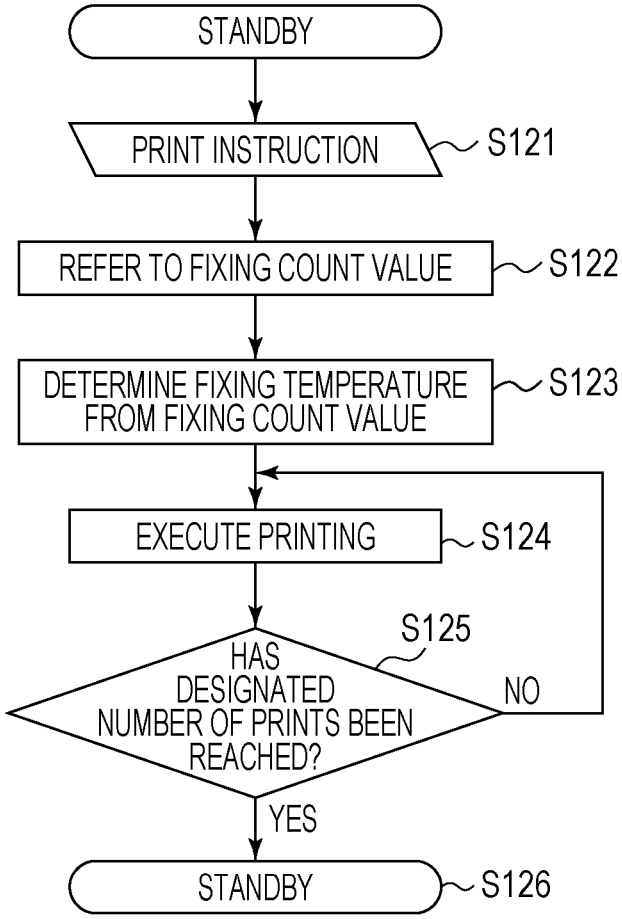
FIG. 8 is a flowchart showing a method for setting the fixing temperature from the standby state of the first embodiment.

Fixing control for performing a print job from the standby state will be described using FIG. 8. When printing is to be performed from the standby state in this embodiment, fixing temperature control is performed in accordance with the control in FIG. 8.

First, in the case where a print instruction is received in the standby state (step S121), the number-of-prints count value Cn is referred to (step S122) because number-of-prints count information based on immediately preceding print job information and stop time information is present in the CPU, a fixing temperature is determined in accordance with the number-of-prints count value Cn referred to (step S122). Thereafter, the designated number of sheets are printed at the set fixing temperature (steps S124 and S215), and after printing is finished, the apparatus goes to a standby state. Thereafter, as in the control described above, after the standby state is maintained for the predetermined time, the heat fixing portion 6 is rotated for 5 seconds, and the apparatus shifts to the sleep mode.

The above control allows appropriate fixing temperature setting even for a print job after returning from the sleep mode, thus preventing fixing defect and hot offset. This embodiment has been described as applied to the case where the heat fixing portion 6 is rotated immediately before the apparatus shifts to the sleep mode, in which "immediately before" includes a case where there is some time between completion of the rotation and the sleep-mode shift timing.

By rotating the heat fixing portion 6 immediately before shifting to the sleep mode, as described above, the degree of warming of the heat fixing portion 6 can be accurately determined from the detection temperature of the thermistor 14 even if the timer stops in the sleep mode, appropriate fixing temperature setting can be performed, and thus, a superior output image without fixing defect and hot offset can be acquired.

Second Embodiment

In this embodiment, an example in which the rotation time T of the heat fixing portion 6 is changed in accordance with the number-of-prints information of a print job immediately before shifting to the sleep mode will be described. The other conditions are the same as those of the foregoing embodiment, and descriptions thereof will be omitted.

As described in the first embodiment, the temperature difference between the heating member 10 the pressure roller 20 is large in a state in which the number of prints is small and the vicinity of the thermistor 14 of the heating member 10 is at high temperature, as in state A of FIG. 5; in contrast, in the case where the number of prints is large as in state C, the entire heat fixing portion 6 is warm, and thus, there is little temperature difference between the heating member 10 and the pressure roller 20. Accordingly, the time necessary for uniformizing the temperature of the heat fixing portion 6 differs depending on the number of prints.

Table 3 shows the results of examination on the numbers of prints and rotation times at which the temperature of the heat fixing portion 6 becomes substantially uniform. Here, the heat fixing portion 6 is rotated after one minute from the end of printing (the time immediately before shifting to the sleep mode is assumed), and the time at which the temperature change becomes small (2 deg/second or less) is the necessary rotation time.

TABLE 3

Number of Prints and Necessary Rotation Time

| Number of Prints | Necessary Rotation Time T |
|---|---|
| 1 | 5 seconds |
| 10 | 5 seconds |
| 25 | 4 seconds |
| 50 | 3 seconds |
| 75 | 1 second |
| 100 | 0 second |

As clearly shown in Table 3, the smaller the number of prints, the longer rotation time T is necessary to uniformize the temperature of the heat fixing portion 6. This is because it takes much time to uniformize the temperature because the temperature difference between the heating member 10 and the pressure roller 20 increases with a decreasing number of prints. After 100 sheets are printed, the temperature change is small at the start of rotation of the heat fixing portion 6, and the entire heat fixing portion 6 was warm.

By setting the rotation time T immediately before shifting to the sleep mode in accordance with the number-of-prints information of a print job processed before shifting to the sleep mode, a value close to the true degree of warming of the heat fixing portion (in particular, the pressure roller 20) can be detected by the thermistor 14, with the rotation time T minimized.

Figure 9:
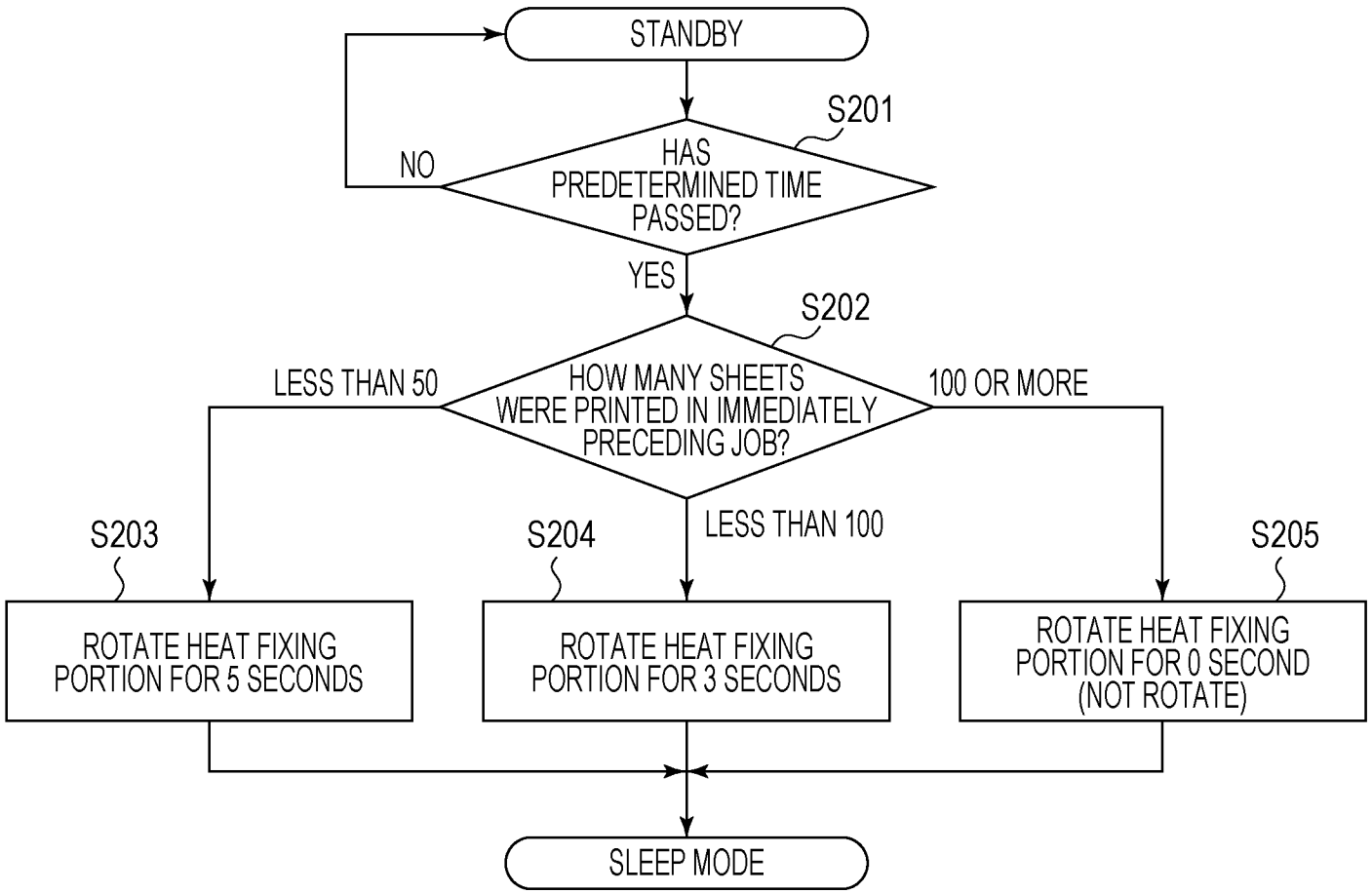
FIG. 9 is a flowchart showing a method for setting the rotation time of the heat fixing portion of a second embodiment.

Next, the details of control for shifting to the sleep mode of this embodiment will be described using a flowchart in FIG. 9. First, an elapsed time from the end of immediately preceding printing is measured in a standby state after printing is finished (step S201), where the standby state is maintained until a predetermined time passes, and after the predetermined time has passed, the rotation time T of the heat fixing portion 6 is determined depending on the number of prints of an immediately preceding print job (step S202). If the immediately preceding print job is of less than 50 sheets, the heat fixing portion 6 is rotated for 5 seconds, and thereafter, the apparatus shifts to the sleep mode (step S203). If the number of prints is less than 100, the heat fixing portion 6 is rotated for 3 seconds, and then the apparatus shifts to the sleep mode (step S204). If the number of prints is 100 or more, the heat fixing portion 6 is rotated for 0 second, in other words, it is not rotated, and the apparatus shifts to the sleep mode (step S205). For printing after returning from the sleep mode, a fixing temperature is determined based on the detection temperature of the thermistor 14, and a designated number of sheets are printed, as in FIG. 7 of the first embodiment.

The above control allows optimum rotation time T to be set depending on the number of prints of a job immediately before shifting to the sleep mode, thus preventing fixing defect and hot offset with a minimum rotation time. Although this embodiment is configured to change the rotation time of the heat fixing portion 6 depending on the number of prints, it can also be changed depending on the number-of-prints count value Cn described in the first embodiment. Although this embodiment has been described as applied to the case where the heat fixing portion 6 is rotated immediately before shifting to the sleep mode, this embodiment may by applied to a case where the rotation is executed after returning from the sleep mode and detecting the temperature with the thermistor 14.

As described above, a high-quality image forming apparatus without fixing defect and hot offset can be provided in which the rotation time of the heat fixing portion 6 is minimized by changing the rotation time of the heat fixing portion 6 depending on the number-of-prints information of a job immediately before shifting to the sleep mode.

Third Embodiment

In this embodiment, an example in which the rotation time T of the heat fixing portion 6 is changed depending on the time from the end of printing to shifting to the sleep mode will be described. The other conditions are the same as those of the foregoing embodiments, and descriptions thereof will be omitted.

The rotation of the heat fixing portion 6 before shifting to the sleep mode is made for the purpose of eliminating the ununiformity in temperature between the heating member 10 and the pressure roller 20, as described above. Accordingly, in the case where the temperature of the heating member 10 is low (in the case where the temperature of the pressure roller 20 is also low), there is no need to rotate the heat fixing portion 6. Accordingly, in the case where the set time from the end of printing to the sleep mode is long, the temperature of the heat fixing portion 6 decreases during that time. Thus, the temperatures of both the heating member 10 and the pressure roller 20 may be low, in which case there is no need to rotate the heat fixing portion 6.

Thus, in this embodiment, the rotation time T immediately before shifting to the sleep mode is set depending on the sleep-mode shift time. This embodiment will be described assuming an apparatus in which a sleep-mode shift time that the user can set is up to one hour on a five-minute basis. Table 4 shows the relationship between the sleep-mode shift time and optimum rotation time T.

TABLE 4

Relationship between Sleep-Mode Shift Time and Heat Fixing Portion Rotation Time

| Sleep-Mode Shift Time | Heat Fixing Portion Rotation Time T |
|---|---|
| 5 minutes or less | 5 seconds |
| More than 5 minutes and less than 30 minutes | 3 seconds |
| 30 minutes or more | 0 second (No rotation) |

Figure 10:
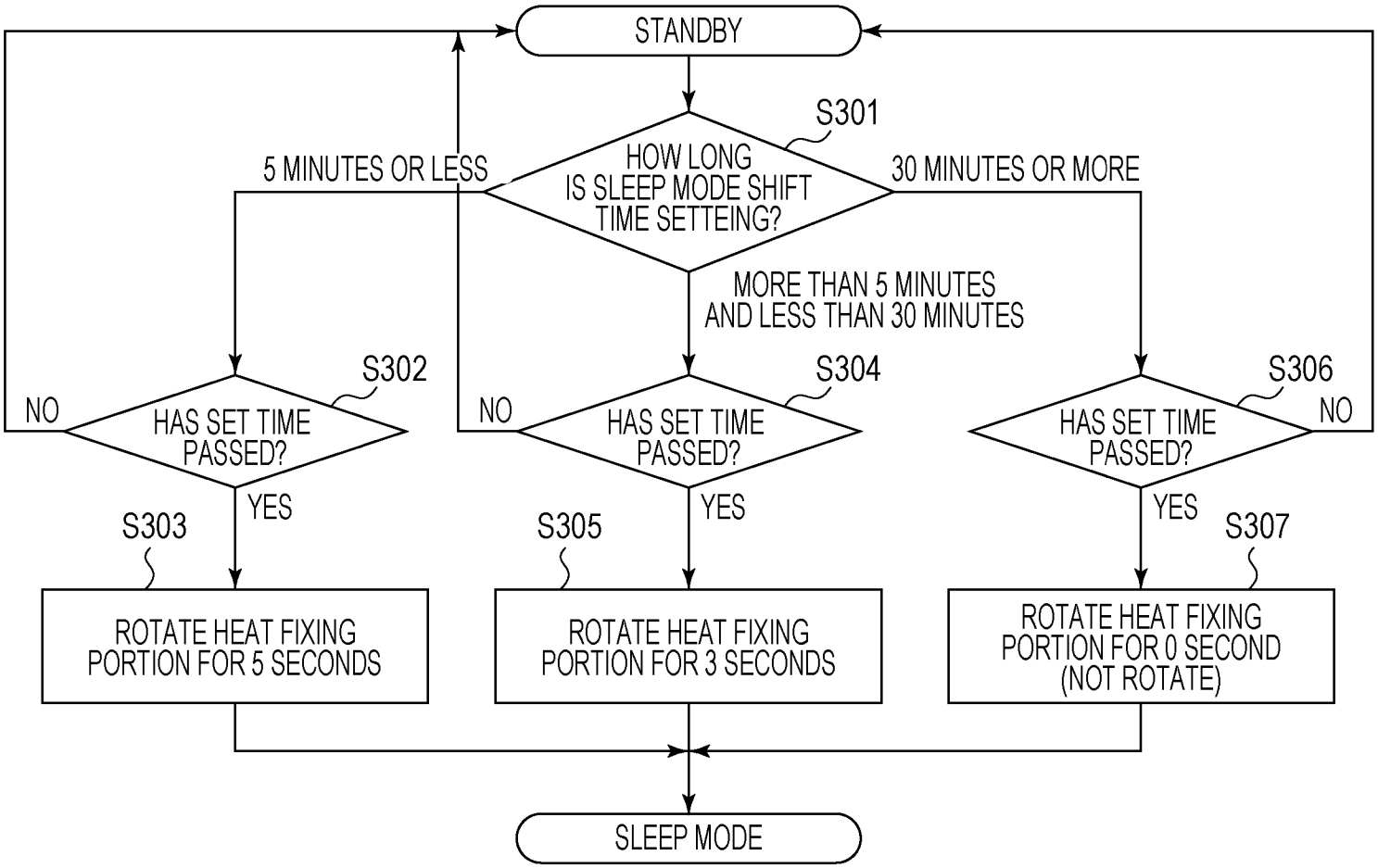
FIG. 10 is a flowchart showing a method for setting the rotation time of the heat fixing portion of a third embodiment (rotation time setting according to a sleep-mode shift time).

Next, the details of control for shifting to the sleep mode of this embodiment will be described using a flowchart in FIG. 10.

First, a sleep-mode shift time that the user sets on an operation panel provided on the image forming apparatus or from a PC connected to the apparatus is checked in a standby state after printing is finished (step S301). Next, if the sleep-mode shift time is 5 minutes or less, the time elapsed from the end of immediately preceding printing is measured (step S302), where the standby state is maintained until the sleep-mode shift time passes, and after the set time has passed, the heat fixing portion 6 is rotated for 5 seconds, and thereafter, the apparatus shifts to the sleep mode (step S303). If the sleep-mode shift time is more than 5 minutes and less than 30 minutes, the time elapsed from the end of immediately preceding printing is measured (step S304), where the standby state is maintained until the set sleep-mode shift time passes, and after a lapse of the set time, the heat fixing portion 6 is rotated for 3 seconds, and the apparatus shifts to the sleep mode (step S305). If the sleep-mode shift time is 30 minutes or more, the time elapsed from the end of immediately preceding printing is measured (step S306), where the standby state is maintained until the sleep-mode shift time passes, and after a lapse of the set time, the apparatus shifts to the sleep mode without rotating the heat fixing portion 6 (rotation time T: 0 second) (step S307). For printing after returning from the sleep mode, a fixing temperature is determined based on the detection temperature of the thermistor 14, and a designated number of sheets are printed, as in FIG. 7 of the first embodiment.

The above control allows optimum rotation time T to be set depending on the sleep-mode shift time, thus preventing fixing defect and hot offset with the minimum rotation time T of the heat fixing portion 6.

In addition to the above method for changing the rotation time T depending on the time to shifting to the sleep mode, a method for changing the rotation time T of the heat fixing portion 6 depending on the detection temperature of the thermistor 14 immediately before shifting to the sleep mode is also beneficial. Table 5 shows the relationship between the detection temperature of the thermistor 14 immediately before shifting to the sleep mode and appropriate rotation time T.

TABLE 5

Relationship between Temperature Immediately Before Shifting to Sleep Mode and Heat Fixing Portion Rotation Time

| Temperature Immediately Before Shifting to Sleep Mode | Heat Fixing Portion Rotation Time T |
|---|---|
| 50° C. or lower | 0 second (No rotation) |
| Higher than 50° C. and lower than 120° C. | 3 seconds |
| 120° C. or higher | 5 seconds |

Figure 11:
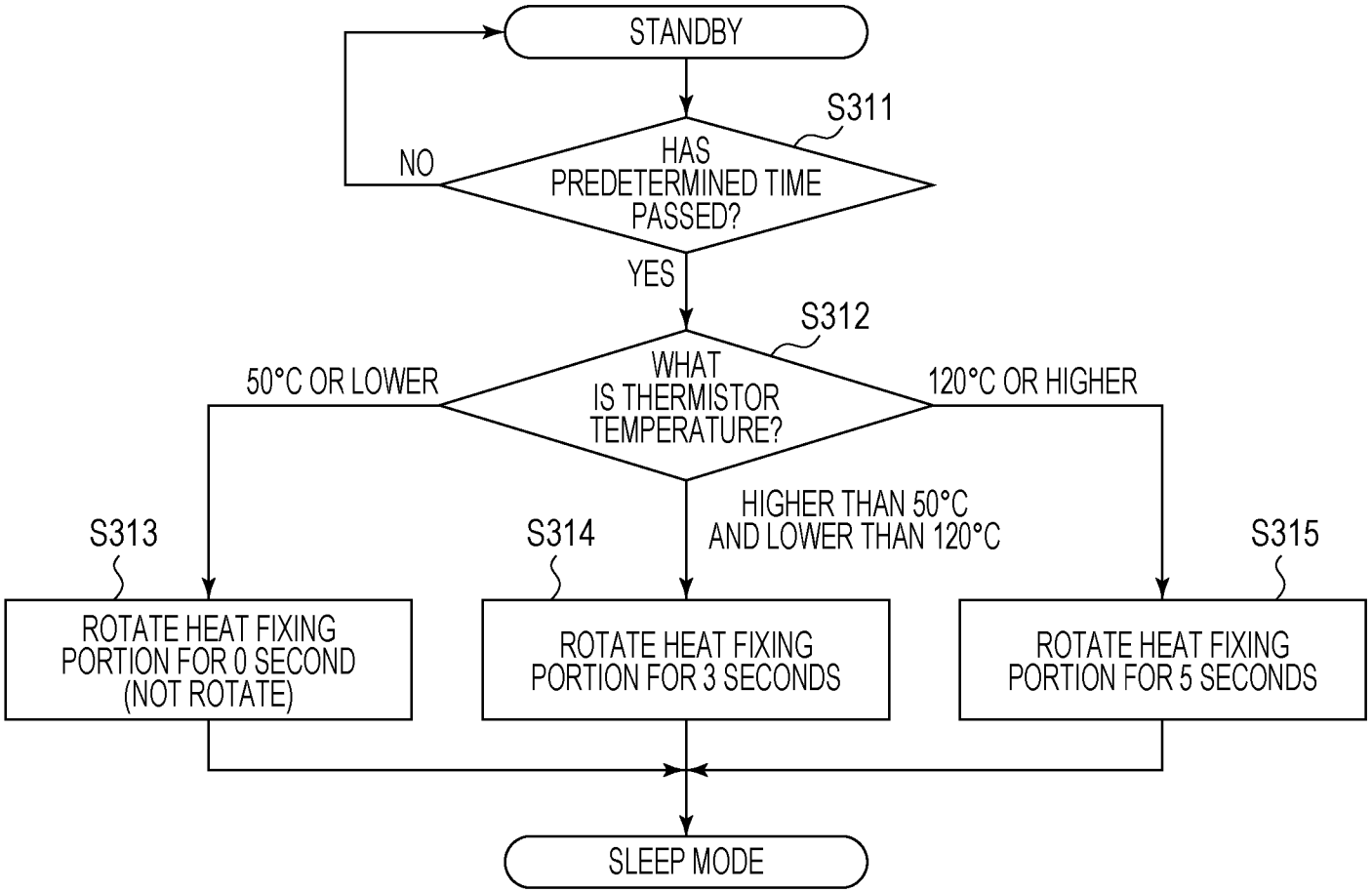
FIG. 11 is a flowchart showing a method for setting the rotation time of the heat fixing portion of a third embodiment (rotation time setting according to a temperature immediately before shifting to the sleep mode).

Control for changing the rotation time T of the heat fixing portion 6 depending on the temperature of the heat fixing portion 6 immediately before shifting to the sleep mode will be described using a flowchart in FIG. 11.

First, a time elapsed from the end of immediately preceding printing is measured in the standby state after printing is finished (step S311), where the standby state is maintained until a predetermined time passes, and after a lapse of the predetermined time, the rotation time T of the heat fixing portion 6 is determined depending on the detection temperature of the thermistor 14 (step S312). If the detection temperature of the thermistor 14 is 50° C. or lower, the apparatus shifts to the sleep mode without rotating the heat fixing portion 6 (rotation time T: 0 second) (step S313). If the detection temperature of the thermistor 14 is higher than 50° C. and lower than 120° C., the heat fixing portion 6 is rotated for 3 seconds, and then the apparatus shifts to the sleep mode (step S314). If the detection temperature of the thermistor 14 is 120° C. or higher, the heat fixing portion 6 is rotated for 5 seconds, and then the apparatus shifts to the sleep mode (step S315). For printing after returning from the sleep mode, a fixing temperature is determined based on the detection temperature of the thermistor 14, and a designated number of sheets are printed, as in FIG. 7 of the first embodiment.

The above control allows optimum rotation time T to be set depending on the temperature of the heat fixing portion 6 immediately before shifting to the sleep mode, thus preventing fixing defect and hot offset with the minimum rotation time T of the heat fixing portion 6.

Thus, fixing defect and hot offset can be prevented while the rotation time T of the heat fixing portion 6 is minimized using the time to shifting to the sleep mode or the detection temperature of the thermistor 14 immediately before shifting to the sleep mode.

In this embodiment, although the methods for changing the rotation time T of the heat fixing portion 6 in three settings depending on the sleep-mode shift time and the temperature of the heat fixing portion 6 immediately before shifting to the sleep mode have been described, for example, a method of controlling an idle running time in multiple steps and a method of changing the rotation time T depending on both of the sleep-mode shift time and the temperature are also possible. Although this embodiment has been described as applied to the case where the heat fixing portion 6 is rotated immediately before shifting to the sleep mode, this embodiment may also be applied to a case where the rotation is executed before returning from the sleep mode and detecting the temperature with the thermistor 14.

Although the three embodiments have been described as applied to an apparatus in which a fixing film is used as a heat fixing portion, the present invention can also be applied to an image forming apparatus equipped with a heat fixing portion that adopts a heating roller system in which a halogen heater is accommodated or a heat fixing portion with another configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-269736 filed on Dec. 2, 2010, which is hereby incorporated by reference herein in its entirety.

What is claimed is:

1. An image forming apparatus comprising:

an image forming portion that forms an image on a recording material;

a fixing portion including a heating member and a pressing member that forms a fixing nip portion with the heating member, the fixing portion fixing the image on the recording material by heating; and a timer, wherein after printing is finished, the apparatus shifts to a standby mode in which power supply to the heating member and rotations of the heating member and the pressing member stop, and in which the timer is activated, and when a power-saving-mode shift time is reached in the standby mode, the apparatus shifts to a power saving mode in which the timer stops, wherein the heating member and the pressing member rotate immediately before shifting to the power saving mode, and wherein a rotation time immediately before shifting to the power saving mode is set according to number-of-prints information of a job processed before shifting to the power saving mode.

2. The apparatus according to claim 1, wherein the heating member includes an endless belt and a heater in contact with an inner surface of the endless belt, and the fixing nip portion is formed by the heater and the pressing member through the endless belt.

3. An image forming apparatus comprising:

an image forming portion that forms an image on a recording material;

a fixing portion including a heating member, a pressing member that forms a fixing nip portion, at which the image is fixed on the recording material by heating, with the heating member, and a temperature detection device that detects a temperature of the heating member; and a timer, wherein after printing is finished, the apparatus shifts to a standby mode in which power supply to the heating member and the rotations of the heating member and the pressing member stop and in which the timer is activated, and when a power-saving-mode shift time is reached in the standby mode, the apparatus shifts to a power saving mode in which the timer stops, wherein when a print job is input in the power saving mode, the apparatus executes an additional rotation of the heating member and the pressing member before the temperature detection device detects the temperature, and wherein a time for the additional rotation after returning from the power saving mode is set according to number-of-prints information of a job processed before shifting to the power saving mode.

4. The apparatus according to claim 3, wherein the heating member includes an endless belt and a heater in contact with an inner surface of the endless belt, and the fixing nip portion is formed by the heater and the pressing member though the endless belt.

5. An image forming apparatus comprising:

an image forming portion that forms an image on a recording material;

a fixing portion including an endless belt, a heater in contact with an inner surface of the endless belt, a pressing member that forms a fixing nip portion, at which the image is fixed on the recording material by heating, with the heater through the endless belt, and a temperature detection device detecting a temperature of the heater;

a control unit controlling a power supply to the heater so that a detection temperature detected by the temperature detection device is maintained at a target temperature; and a timer measuring a time period of a printing intermission, wherein the timer is available in a standby mode and the timer is unavailable in a power saving mode, wherein after printing is finished, the apparatus shifts to the standby mode in which the power supply and rotations of the endless belt and the pressing member stop, and when a power-saving-mode shift time is reached in the standby mode, the apparatus shifts to the power saving mode, wherein the endless belt and the pressing member rotate immediately before shifting to the power saving mode, and wherein the apparatus sets the target temperature in a fixing process when a print job is input in the power saving mode, the target temperature in the fixing process depending on the detection temperature at a start of printing.

6. The apparatus according to claim 5, wherein a rotation time immediately before shifting to the power saving mode is set according to number-of-prints information of a job processed before shifting to the power saving mode.

7. The apparatus according to claim 5, wherein a rotation time immediately before shifting to the power saving mode is set according to the power-saving-mode shift time or the detection temperature immediately before shifting to the power saving mode.

8. An image forming apparatus comprising:

an image forming portion that forms an image on a recording material;

a fixing portion including an endless belt, a heater in contact with an inner surface of the endless belt, a pressing member that forms a fixing nip portion, at which the image is fixed on the recording material by heating, with the heater through the endless belt, and a temperature detection device provided on the heater for detecting a temperature of the heater;

a control unit controlling a power supply to the heater so that a detection temperature detected by the temperature detection device is maintained at a target temperature; and a timer measuring a time period of a printing intermission, wherein the timer is available in a standby mode and the timer is unavailable in a power saving mode, wherein after printing is finished, the apparatus shifts to the standby mode in which a power supply to the heating member and rotations of the endless belt and the pressing member stop, and when a power-saving-mode shift time is reached in the standby mode, the apparatus shifts to the power saving mode, and wherein when a print job is input in the power saving mode, the apparatus executes an additional rotation of the endless belt and the pressing member before the temperature detection device detects the temperature of the heater and sets the target temperature in a fixing process depending on the detection temperature immediately after the additional rotation.

9. The apparatus according to claim 8, wherein a time for the additional rotation after returning from the power saving mode is set according to number-of-prints information of a job processed before shifting to the power saving mode.

10. The apparatus according to claim 8, wherein a time for the additional rotation after returning from the power saving mode is set according to the power-saving-mode shift time or the detection temperature immediately before shifting to the power saving mode.

* * * * *